United States Patent [19]

Accornero

[11] 4,245,427

[45] Jan. 20, 1981

[54] TOY VEHICLE WITH NOISEMAKER

[75] Inventor: Louis Accornero, Hempstead, N.Y.

[73] Assignee: Aurora Products Canada Limited, Rexdale, Canada

[21] Appl. No.: 3,832

[22] Filed: Jan. 16, 1979

[51] Int. Cl.[3] ..... A63H 5/00

[52] U.S. Cl. ..... 46/111; 46/192

[58] Field of Search ..... 46/111, 112, 113, 114, 46/189, 190, 191, 192, 204

[56] References Cited

U.S. PATENT DOCUMENTS

| | | | |
|---|---|---|---|
| 2,348,129 | 5/1944 | Guldbrandsen | 46/190 X |
| 2,603,035 | 7/1952 | Countryman et al. | 46/111 X |
| 2,978,836 | 4/1961 | Kato | 46/111 X |
| 3,165,860 | 1/1965 | Glass et al. | 46/111 |

FOREIGN PATENT DOCUMENTS

| | | | |
|---|---|---|---|
| 1020264 | 11/1957 | Fed. Rep. of Germany | 46/111 |

*Primary Examiner*—Robert Peshock
*Assistant Examiner*—Mickey Yu
*Attorney, Agent, or Firm*—Blum, Kaplan, Friedman, Silberman & Beran

[57] ABSTRACT

A toy vehicle with noisemaker includes a closed rectangular resonating chamber with a hard flexible diaphragm forming the upper chamber surface. An idler wheel in the gear train between the vehicle's electric motor and the driven rear wheels has cam profiles molded in its flat surface. A hammer pin extending through a rigid chamber wall rides on the cam profiles and continuously and alternately flexes and releases the diaphragm. When released, the diaphragm unflexes and drives against a rigid stop. The impact of the hard diaphragm against the stop oscillates the diaphragm and causes a sound which the resonating chamber amplifies. The sound is produced twice with each revolution of the idler wheel.

18 Claims, 4 Drawing Figures

FIG. 1
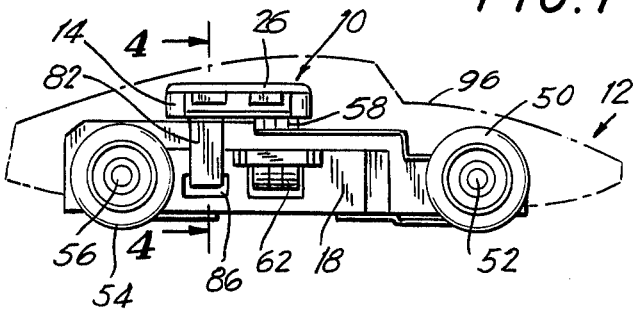
FIG. 3
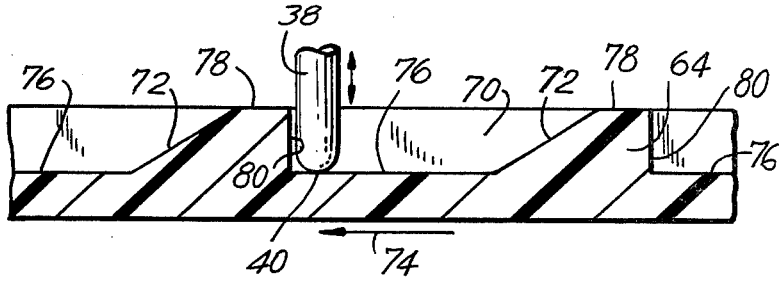
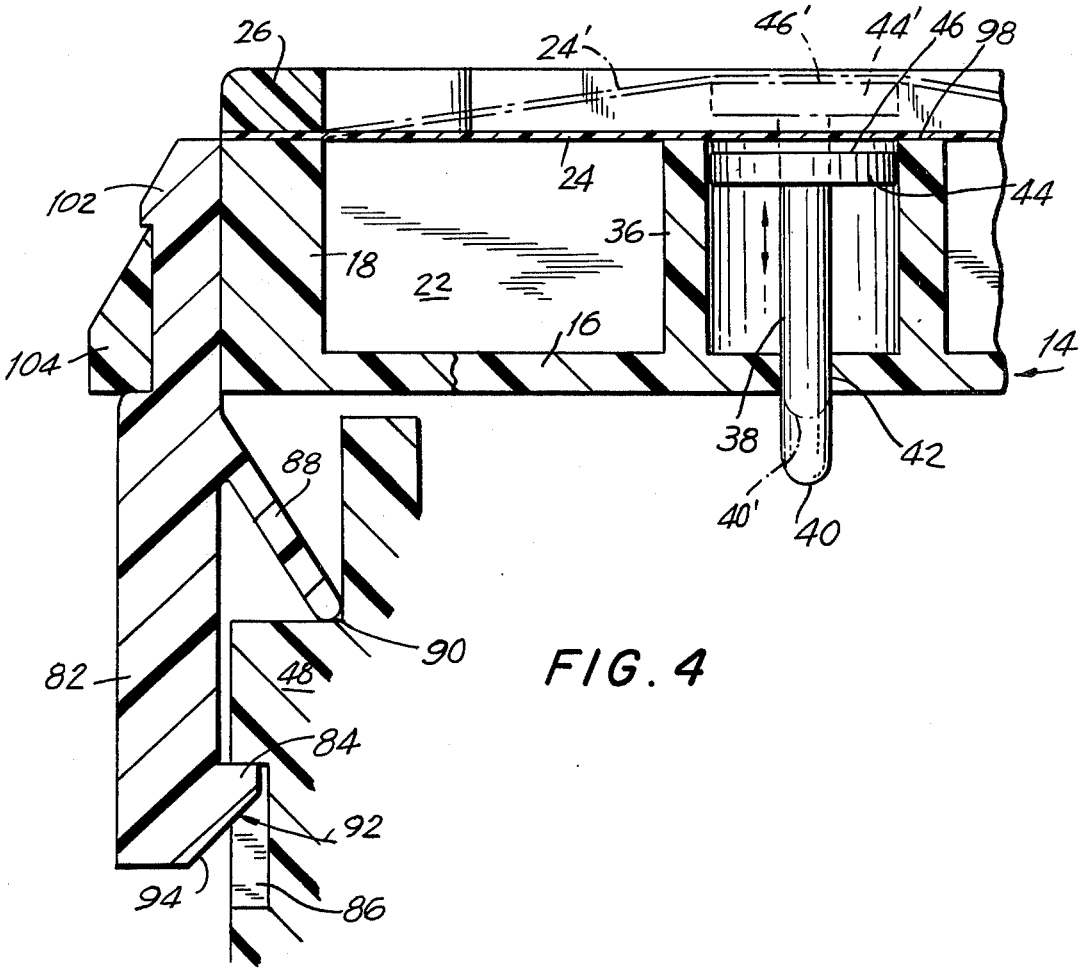
FIG. 4

TOY VEHICLE WITH NOISEMAKER

BACKGROUND OF THE INVENTION

This invention relates generally to a toy vehicle for children and more particularly to a toy vehicle having a self-contained electric motor and used for racing on a model track. Miniature toy vehicles of this general type running on a closed track have been successfully manufactured and marketed over a period of years. These items are extremely popular with children and adults alike. Realism is an important part of the appeal of these toys. Efforts are continuously made to produce miniature vehicles which are detailed models of actual or realistic looking vehicles. However, in the prior art, the miniature electric vehicles have not reproduced in any authentic manner the sound of racing cars in operation. Thus, part of the atmosphere of the actual racetrack is absent.

What is needed is a toy vehicle for miniature car racing which not only realistically reproduces the appearance of the racecar but also provides sounds which simulate the operation of these cars.

SUMMARY OF THE INVENTION

Generally speaking, in accordance with the invention, an electrically operated toy vehicle with noisemaker suitable for miniature tracks, is provided. The toy vehicle with noisemaker includes a closed rectangular resonating chamber with a hard flexible diaphragm forming the upper chamber surface. An idler wheel in the gear train between the vehicle's electric motor and the driven rear wheels has cam profiles molded in its flat surface. A hammer pin extending through a chamber wall rides on the cam profiles and continuously and alternately flexes and releases the diaphragm. When released, the diaphragm unflexes and drives against a rigid stop. The impact of the hard diaphragm against the stop oscillates the diaphragm and causes a sound which the resonating chamber amplifies. The sound is produced twice with each revolution of the idler wheel and its repetition rate is directly related to the motor speed.

The resonating chamber and cam idler wheel are added to the vehicle without alteration of the primary vehicle structure. The noisemaker is concealed by the vehicle's appearance shell.

Accordingly, it is an object of this invention to provide a toy vehicle for miniature car racing which includes a noisemaker.

Another object of this invention is to provide a toy vehicle with noisemaker which provides a noise whose repetition rate is directly related to the rotation rate of the vehicle's electric motor.

A further object of this invention is to provide a toy vehicle with noisemaker which allows for the addition and removal of the noisemaker without alteration in the primary vehicle structure.

Still other objects and advantages of the invention will in part be obvious and in part be apparent from the specifications.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a side view of the chassis of a miniature vehicle having a noisemaker in accordance with the present invention showing the chassis in full line and an outline of the car shell or body in phantom lines;

FIG. 3 is a sectional view of the cam profile and hammer pin used in the noisemaker of this invention;

FIG. 4 is a section taken along the line 4—4 of FIG. 1.

DESCRIPTION OF THE PREFERRED EMBODIMENTS

Figure 2:
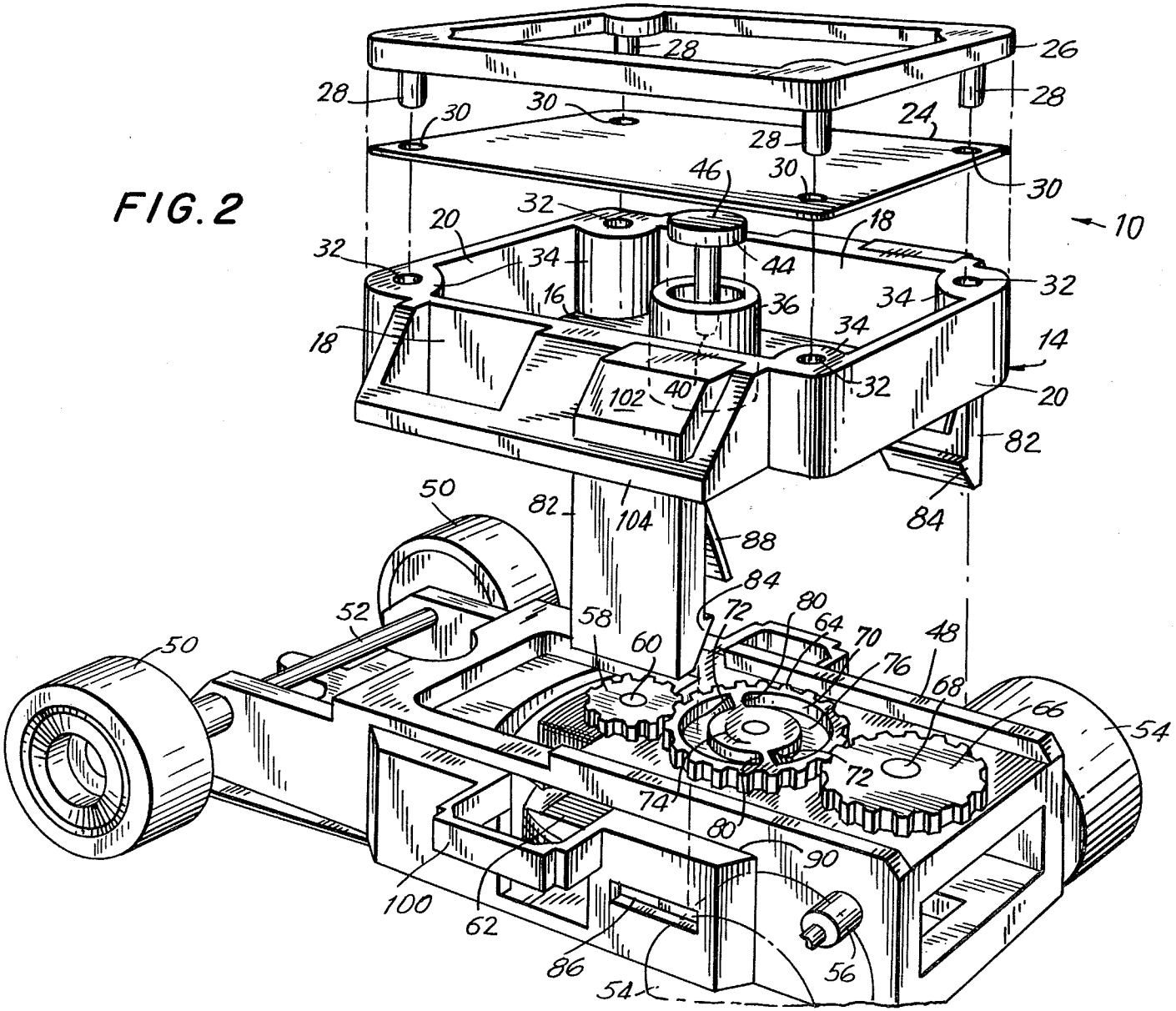
FIG. 2 is an exploded perspective view of the vehicle of FIG. 1.

With reference to the Figures, the noisemaker 10 on the vehicle 12 of this invention includes a rectangular pan 14 open at the top and having a base 16, a pair of opposed vertical lateral sides 18, and a pair of opposed vertical longitudinal ends 20, which enclose on five sides an internal volume 22. A hard flexible diaphragm 24 rests atop peripheral edges of the rectangular pan 14 and provides the upper closure for the internal volume 22. The rectangular frame 26 rests atop the flexible diaphragm 24 and frame pins 28 extending from the corners of the frame 26 pass through corner holes 30 in the flexible diaphragm 24, and enter registered holes 32 in bosses 34 located at the corners of the rectangular pan 14. The frame pins 28 are fixedly attached in the pan holes 32 by means of any suitable fastening, for example, an adhesive applied to the pins 28, or by means of a press fit between the pins 28 and the holes 32. Thus an integral chamber with the enclosed internal volume 22 is formed, closed on all six sides and having the hard flexible diaphragm 24 substantially exposed at the top surface.

The collar 36 is integrally attached to the base 16 of the rectangular pan 14 and extends upwardly to be substantially flush with the diaphragm 24 in its unflexed condition (FIG. 4). A flatheaded hammer pin 38 slides within the collar 36 and the lower extremity 40 of the hammer pin 38 extends through a hole 42 in the base 16 of the rectangular pan 14. The lower extremity 40 of the hammer pin 38 is rounded and serves as a cam follower as explained more fully hereinafter. The head 44 of the hammer pin 38 is substantially flat on its upper surface 46 and thus provides a broad area of contact with the diaphragm.

The chassis of the vehicle 12 comprises a frame 48, a pair of front wheels 50 mounted on the front axle shaft 52, and a pair of rear wheels 54 mounted on the rear axle 56. The pinion 58 is rigidly attached to the verticle shaft 60 of the electrical motor 62. The rear wheels 54 are driven by the pinion 58 through the idl r gear 64 and the drive gear 66. Shaft 68 rotates with the drive gear 66 and causes a beveled pinion and gear (not shown) on the rear axle 56 to rotate, thereby causing the rear wheels 54 to rotate when the motor 62 is electrically energized. This gear train between the electrical motor 62 and the rear axle 56 is well known in toy vehicles of this type. The mechanism for electrically energizing the motor by means of brushes in contact with the closed track rails used with this vehicle is also well known. For example, U.S. Pat. No. 3,964,206 discloses a similar vehicle and discloses details of a similar drive mechanism and electrical system. For this reason the electrical system, the motor, and the rear axle drive receive no further detailed description herein.

The idler gear 64 has a pair of cam profiles 70 or grooves molded into the top exposed surface of the idle gear. When the noisemaker 10 is attached to the vehicle frame 48, the lower extremity 40 of the hammer pin 38 extends below the base 16 of the rectangular pan 14, and rides in the cam groove 70 on the idler 64 so as to follow the cam profiles as the idler gear 64 rotates. As best seen in FIG. 3, the cam profile 70 is designed for a relatively slow rise of the hammer pin 38 followed by a quick return when the idler gear 64 rotates in the direction indicated by the arrow 74. It can be seen from FIG. 3 that the hammer pin 38 has no vertical motion as it rides along the lower flat surface 76 of the cam groove 70. The hammer pin 38 rises on the inclined cam profile 72 and then rides on the upper flat surface 78 of the gear 64. After a short period of travel on the upper surface 78, the hammer pin 38 drops back to lower surface 76 as it passes the substantially vertical surface 80. The lower extremity 40 of the hammer pin 38 rides on the inclined cam profile 72 and upper surface 78 for approximately 10 to 20% of the time of a cam cycle.

Brackets 82 extend down from the sides 18 of the rectangular pan 14, and hook ends 84 engage lateral slots 86 on the sides of the vehicle frame 48. Stabilizer bars 88 nest in the corner 90 of the frame 48 to further stabilize the position of the noisemaker 10 on the frame 48 of the vehicle 12. The brackets 82 are rigidly attached to the rectangular pan 14 by interlocking the hooked upper ends 102 of the brackets 82 between the sides 18 and the side bars 104 on the rectangular pan 14. The brackets 82 are made of material which allows a degree of flexibility. Thus the noisemaker 10 may be removed in toto from the vehicle frame 48 merely by exerting a slight outward pressure as indicated by the arrow 92 on the inclined surfaces 94, one on each side of the noisemaker 10. Thus, the noisemaker 10 is removed or put into position without altering the remaining primary structure of the vehicle 12. It should be understood that the vehicle's appearance shell 96 must be removed when the noisemaker 10 is to be attached or removed from the vehicle 12.

In operation, the lower extremity 40 of the hammer pin 38 rides continuously in the cam grooves 70 molded into the upper surface of the idler gear 64. When the hammer pin 38 rides on the lower flat surface 76 there is no contact between the hammer pin 38 and the diaphragm 24. As the hammer pin 38 rides up the inclined cam profile 72 and along the flat top cam surface 78, the diaphragm is deflected upwards to the position indicated in FIG. 4 by the reference number 24' due to the pressure exerted by the upper surface 46' of the hammer pin 38'. The prime (') symbol connotes the elevated position of the hammer pin 38. When the hammer pin 38 falls off the flat upper surface 78 of the drive gear 64, the hard diaphragm 24 is released and snaps back to its original position driving the hammber pin 38 downward. The downward motion of the diaphragm 24 is arrested by the upper surface 98 of the collar 36. The impact of the hard diaphragm 24 against the collar 36 causes the diaphragm 24 to oscillate and in conjunction with the enclosed resonating volume 22 of the noisemaker 10 produces a sound which is repeated each time the hammer pin 38 falls from the upper flat surfaces 78 of the idler gear 64. Thus, when the motor 62 turns at a high speed, the idler gear 64 correspondingly turns at a high speed and the noises produced by the noisemaker 10 of this invention occur at a higher frequency. Similarly, when the motor 62 operates at a low speed the noises occur at a lower repetition rate.

The vehicle 12 is completed by the appearance shell 96 which is removably attached to the frame 48 by engagement to the side brackets 100 incorporated in the frame 48 of the vehicle 12.

It should be understood that in alternative embodiments of this invention, the cam profiles can be incorporated in any rotating member. For example, the cam actuator could be on the armature shaft, the pinion gear, the crown gear, the rear axle or rear hubs, with an orientation of the resonator chamber 14 to provide engagement between the hammer pin 38 and the cam profile grooves. Also, the number of cam profiles which are incorporated on a rotating member may be varied. Two profiles 70, as described above, perform satisfactorily, however, one, two, three, or more profiles may be utilized to produce the desired noise repetition rate.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A miniature toy vehicle comprising:

a vehicle frame including wheels mounted for rotation;

a cam profile operatively connected to at least one of said wheels;

a cam follower engaging said cam profile whereby said cam follower moves relative to said cam profile when said at least one operatively connected wheel is rotated;

noisemaking means coupled to said cam follower for making a sound in response to each cycle of displacement of said cam follower, said sound being repeated at a frequency proportional to the speed of rotation of said at least one wheel, said noisemaking means including a flexible diaphragm, said diaphragm being flexed and released by said cam follower when said cam follower and said cam profile move relatively one to the other and;

a mechanical stop, said diaphragm when released striking said stop to produce said sound;

whereby a sound is produced in direct relationship to rotation of said at least one operatively connected wheel.

2. The miniature toy vehicle of claim 1, wherein said flexible diaphragm is fabricated of hard material.

3. The miniature toy vehicle of claim 1, wherein said flexible diaphragm is a wall of a chamber whereby said sound resonates and is amplified.

4. The miniature toy vehicle of claim 3, wherein said cam follower acts inside said chamber to deflect said diaphragm from the inside of said chamber, and said mechanical stop is positioned within said chamber.

5. The miniature toy vehicle of claim 1, and further comprising an appearance shell removably attached to said vehicle frame.

6. The miniature toy vehicle of claim 1, wherein said cam profile is contoured to cause said cam follower to rise slowly and return rapidly when said cam follower moves relative to said cam profile whereby said diaphragm is flexed slowly and released rapidly.

7. The miniature toy vehicle of claim 6, wherein said diaphragm is flexed for 10 to 20 percent of each diaphragm cycle.

8. The miniature toy vehicle of claim 1 and further comprising a motor with an output shaft, and drive means for causing said at least one operatively connected wheel to rotate to drive said vehicle when said motor shaft rotates.

9. The miniature toy vehicle of claim 8, wherein said drive means is a gear train, said gear train connected between said motor shaft and the axle of said at least one operatively connected wheel.

10. The miniature toy vehicle of claim 9, wherein said cam profile is incorporated in the face of one gear in said gear train.

11. The miniature toy vehicle of claim 1, wherein said cam profile is operatively connected to said at least one of said wheels by means of gearing, and said cam profile is incorporated in the face of one gear in said gearing.

12. The miniature toy vehicle of claim 1, wherein said cam profile is positioned circumferentially on said face of said gear whereby said sound is produced continuously and repetitively when said wheel rotates.

13. A miniature toy vehicle comprising:

a vehicle frame including wheels mounted for rotation;

a cam profile operatively connected to at least one of said wheels;

a cam follower engaging said cam profile whereby said cam follower moves relative to said cam profile when said at least one operatively connected wheel is rotated;

noisemaking means coupled to said cam follower for making a sound in response to each cycle of displacement of said cam follower, said sound being repeated at a frequency proportional to the speed of rotation of said at least one wheel;

a motor with an output shaft;

drive means for causing said at least one operatively connected wheel to rotate to drive said vehicle when said motor shaft rotates, said drive means being a gear train, said gear train connected between said motor shaft and the axle of said at least one operatively connected wheel, said cam profile being incorporated in the face of one gear in said gear train, said gear train comprising a pinion on said motor shaft connected to an intermediate idler wheel which in turn connects to a drive gear connected to said axle of said at least one operatively connected wheel, and said cam profile is on the face of said idler wheel.

14. The miniature toy vehicle of claim 13, wherein said cam profile is positioned circumferentially on said face of said idler gear whereby said sound is produced continuously and repetitively when said motor shaft rotates said connected wheel.

15. The miniature toy vehicle of claim 14, wherein said diaphragm is flexed in response to said cam profile more than one time for each complete revolution of said idler wheel.

16. The miniature toy vehicle of claim 8 or 13, wherein said motor is an electric motor.

17. A miniature toy vehicle comprising:

a vehicle frame including wheels mounted for rotation;

a cam profile operatively connected to at least one of said wheels;

a cam follower engaging said cam profile whereby said cam follower moves relative to said cam profile when said at least one operatively connected wheel is rotated;

noisemaking means coupled to said cam follower for making a sound in response to each cycle of displacement of said cam follower, said sound being repeated at a frequency proportional to the speed of rotation of said at least one wheel, said noisemaking means including a chamber for resonating and amplifying said sound;

means for attachment of said chamber to said vehicle frame, said means for attachment including lateral brackets having hooked ends, said hooked ends engaging lateral slots in said vehicle frame.

18. The miniature toy vehicle of claim 17, wherein said lateral brackets are fabricated of flexible material whereby said chamber is removable from said vehicle frame and attachable to said vehicle frame without alteration of said vehicle frame.

* * * * *